US007658371B2

(12) United States Patent
Deschryver

(10) Patent No.: US 7,658,371 B2
(45) Date of Patent: Feb. 9, 2010

(54) MAGNETIC STRIP REMOVABLE PORTION FORMAT

(75) Inventor: David Deschryver, Broadview, IL (US)

(73) Assignee: Lehigh Press, Inc., Broadview, IL (US)

( * ) Notice: Subject to any disclaimer, the term of this patent is extended or adjusted under 35 U.S.C. 154(b) by 394 days.

(21) Appl. No.: 11/327,763

(22) Filed: Jan. 6, 2006

(65) Prior Publication Data

US 2006/0108731 A1 May 25, 2006

(51) Int. Cl.
*B41F 13/58* (2006.01)

(52) U.S. Cl. ..... 270/5.03; 270/21.1; 53/553; 283/101

(58) Field of Classification Search ..... 270/4, 270/5.01, 5.02, 5.03, 10, 20.1, 21.1; 53/203, 53/206, 450, 461, 548, 550, 553; 283/100, 283/101

See application file for complete search history.

(56) References Cited

U.S. PATENT DOCUMENTS

| | | | |
|---|---|---|---|
| 2,997,417 | A | 8/1961 | Dirks |
| 3,579,947 | A | 5/1971 | Kalman |
| 3,808,768 | A | 5/1974 | Dobbs |
| 4,034,210 | A | 7/1977 | Hill et al. |
| 4,063,398 | A | 12/1977 | Huffman |
| 4,071,997 | A | 2/1978 | Gunther, Jr. et al. |
| 4,189,895 | A | 2/1980 | Volkert et al. |
| 4,215,626 | A | 8/1980 | Giulianotto |
| 4,455,809 | A | 6/1984 | Dallaserra |
| 4,769,969 | A | 9/1988 | Minami |
| 4,790,119 | A | 12/1988 | McDaniels |
| 4,896,027 | A | 1/1990 | Drexler |
| 4,912,909 | A | 4/1990 | Stenner |
| 5,137,304 | A | 8/1992 | Silverschotz et al. |
| 5,160,022 | A | 11/1992 | Mennella |
| 5,417,458 | A | 5/1995 | Best et al. |
| 5,632,842 | A | 5/1997 | Oliver et al. |
| 5,727,817 | A | 3/1998 | Kraige |
| 5,776,287 | A | 7/1998 | Best et al. |

(Continued)

FOREIGN PATENT DOCUMENTS

| | | |
|---|---|---|
| CA | 2097819 | 12/1990 |

(Continued)

*Primary Examiner*—Ren Yan
(74) *Attorney, Agent, or Firm*—Trexler, Bushnell, Giangiorgi, Blackstone & Marr, Ltd.

(57) ABSTRACT

A system for producing removable portions having personalized information, for mass-distributable packets, by single-pass manufacturing, in which a printed web is slit into two ribbons, one of which is then folded and glued upon itself to create a multi-ply ribbon that appears to be of heavier stock than the original paper, and a label containing a magnetic strip is applied. The magnetic strip can be encoded with information personalized to the recipient or the advertiser. Alternatively, the multi-ply ribbon can be created by gluing together multiple ribbons, or by a combination of folding ribbons and gluing ribbons. The multi-ply ribbon is die cut into an inside portion and an outside portion and married to the other ribbon, after which the outside portion is removed, leaving the inner portion as removable portions. Alternatively, the folded ribbon can be kiss cut after it has been married to the other ribbon. The removable portions can be coated or laminated to simulate plastic and can be printed with information personalized for the advertiser or for the recipient.

13 Claims, 9 Drawing Sheets

U.S. PATENT DOCUMENTS

| | | | | |
|---|---|---|---|---|
| 5,869,148 | A | 2/1999 | Silverschotz et al. | |
| 5,988,620 | A | 11/1999 | Graushar | |
| 6,022,051 | A | 2/2000 | Casagrande | |
| 6,039,356 | A | 3/2000 | Warther et al. | |
| 6,070,391 | A | 6/2000 | Honegger | |
| 6,089,611 | A | 7/2000 | Blank | |
| 6,092,841 | A | 7/2000 | Best et al. | |
| 6,152,029 | A | 11/2000 | Templeton | |
| 6,162,160 | A | 12/2000 | Ohshima et al. | |
| 6,315,023 | B1 | 11/2001 | King et al. | |
| 6,386,591 | B1 | 5/2002 | Blank | |
| 6,481,994 | B1 | 11/2002 | McCannel et al. | |
| 6,520,542 | B2 | 2/2003 | Thompson et al. | |
| 6,588,658 | B1 | 7/2003 | Blank | |
| 6,623,039 | B2 | 9/2003 | Thompson et al. | |
| 6,658,817 | B1 | 12/2003 | Eve et al. | |
| 6,712,398 | B1 | 3/2004 | Fox et al. | |
| 6,743,493 | B2 | 6/2004 | Crum et al. | |
| 6,749,230 | B1 | 6/2004 | Casagrande | |
| 6,773,035 | B1 | 8/2004 | Cox et al. | |
| 6,814,375 | B2 | 11/2004 | Cox et al. | |
| 6,849,149 | B2 | 2/2005 | Otaki et al. | |
| 6,877,666 | B2 | 4/2005 | Goade, Sr. et al. | |
| 6,902,107 | B2 | 6/2005 | Shay et al. | |
| 6,902,518 | B2 | 6/2005 | Bretl | |
| 6,964,810 | B2 | 11/2005 | McCannel et al. | |
| 6,986,953 | B2 | 1/2006 | Crum | |
| 6,994,262 | B1 | 2/2006 | Warther | |
| 7,017,899 | B2 | 3/2006 | Romita et al. | |
| 7,024,807 | B2 | 4/2006 | Street | |
| 7,040,665 | B2 | 5/2006 | Ritchie et al. | |
| 7,080,776 | B2 | 7/2006 | Lewis et al. | |
| 7,083,086 | B2 | 8/2006 | Whitaker | |
| 2002/0062898 | A1 * | 5/2002 | Austin et al. | 156/64 |
| 2003/0028439 | A1 | 2/2003 | Cox et al. | |
| 2003/0077465 | A1 | 4/2003 | Boudouris et al. | |
| 2003/0129443 | A1 | 7/2003 | McCannel et al. | |
| 2003/0150919 | A1 | 8/2003 | Blank | |
| 2003/0207744 | A1 | 11/2003 | Bretl | |
| 2004/0026915 | A1 | 2/2004 | Thompson et al. | |
| 2004/0089706 | A1 | 5/2004 | Hill et al. | |
| 2005/0006445 | A1 | 1/2005 | Katz | |
| 2005/0017502 | A1 | 1/2005 | Chariker | |
| 2005/0045732 | A1 | 3/2005 | Whitaker | |
| 2005/0064127 | A1 | 3/2005 | Turner et al. | |
| 2005/0123705 | A1 | 6/2005 | Dronzek et al. | |
| 2006/0087112 | A1 | 4/2006 | Ritchie et al. | |
| 2006/0108731 | A1 | 5/2006 | Deschryver | |
| 2006/0124757 | A1 | 6/2006 | Warther | |
| 2006/0125168 | A1 | 6/2006 | Romita et al. | |

FOREIGN PATENT DOCUMENTS

| | | | |
|---|---|---|---|
| CA | 2076639 | | 8/1991 |
| CA | 2091447 | | 3/1993 |
| CA | 2095912 | | 12/1993 |
| CA | 2156264 | | 9/1994 |
| CA | 2158851 | | 9/1994 |
| CA | 2159084 | | 9/1994 |
| CA | 2134400 | | 10/1994 |
| CA | 2212436 | | 6/1997 |
| CA | 2212538 | | 7/1997 |
| CA | 2207230 | | 12/1997 |
| CA | 2275553 | | 12/1997 |
| CA | 2209479 | | 1/1998 |
| CA | 2218324 | | 4/1998 |
| CA | 2219548 | | 5/1998 |
| CA | 2290828 | | 5/1998 |
| CA | 2224377 | | 6/1998 |
| CA | 2294747 | | 6/1998 |
| CA | 2268890 | | 4/1999 |
| CA | 2270454 | | 4/1999 |
| CA | 2447893 | | 4/1999 |
| CA | 2290105 | | 11/1999 |
| CA | 2322237 | | 10/2000 |
| CA | 2407561 | | 2/2001 |
| CA | 2407585 | | 2/2001 |
| CA | 2351142 | | 6/2001 |
| CA | 2351448 | | 6/2001 |
| CA | 2353283 | | 7/2001 |
| CA | 2355474 | | 8/2001 |
| CA | 2494954 | | 8/2003 |
| CA | 2444751 | | 10/2003 |
| CA | 2447733 | | 10/2003 |
| CA | 2500879 | | 3/2005 |
| CA | 2505646 | | 4/2005 |
| CA | 2525349 | | 11/2005 |
| CA | 2528289 | | 11/2005 |
| CA | 2218324 | | 9/2007 |
| EP | 298687 | | 1/1989 |
| EP | 329370 | | 8/1989 |
| FR | 2806030 | | 9/2001 |
| WO | WO 92/00878 | A1 | 1/1992 |
| WO | WO9205036 | | 4/1992 |
| WO | WO03000505 | | 1/2003 |
| WO | WO 03/095114 | A1 | 11/2003 |
| WO | 2005021284 | | 3/2005 |

* cited by examiner

MAGNETIC STRIP REMOVABLE PORTION FORMAT

FIELD OF THE INVENTION

This invention is generally directed to an in-line finishing system for manufacturing a heavier-stock, removable portion, having personalized information encoded thereon, to incorporate in a mass-distributable packet, in a single-pass manufacturing process, using no premanufactured portions.

BACKGROUND OF THE INVENTION

Advertisers commonly use mass-distributable packets to promote their products. These packets are distributed by mail, by insert into newspapers or other periodicals, by hand delivery, or otherwise.

Advertisers often wish to include a removable portion in the advertising materials. A removable portion is generally a piece of smaller dimensions than the packet, and is usually printed on a heavier stock. A removable portion can take the form of, by way of example and not by way of limitation, a facsimile credit card in a credit card advertisement; a discount card, such as for a certain dollar amount or certain percentage off the price of merchandise or services; a gift card; a loyalty card; or a temporary membership card for an organization such as a health club. Either the packet or the removable portion can be personalized in a variety of ways as is known in the art.

Removable portions are often used for promotional purposes in advertising, but can be used for other purposes and the present invention as described herein is not limited to removable portions used in advertising. For example, an organization could use the present invention to prepare actual membership cards or admission tickets.

One variety of the current practice calls for printing mass-distributable packets on a web press. The packets are prepared by printing the information to appear on the packets in a plurality of longitudinal areas extending parallel to the web, cutting the web longitudinally between the print patterns to form ribbons, superimposing the cut ribbons in a vertical registry, and then cutting the ribbons transversely to form the sets of printed pieces. The ribbons can be folded and cut in a variety of ways to create many different forms.

Because the removable portion is usually of a heavier stock paper than the advertising materials, the removable portion cannot be easily printed on the same web press at the same time as the advertising materials. Therefore, removable portions are printed separately, by known methods, and added to the packet in a "tip on" process. Accordingly, a separate printing apparatus is needed, either a web press or other printing machine, or an outside vendor must print the removable portions separately. The removable portions sometimes can be printed on the same web press that prints the packets, but not at the same time, since the removable portion is of a heavier stock than the main packet. Some printing equipment cannot print paper of the thickness desired for a removable portion, so a separate press is required, either in-house or at an outside vendor.

Problems arise in this current method of manufacture. Utilizing a second printing apparatus for the removable portion adds capital expense and labor costs. Using an outside vendor adds costs and creates quality control problems. Regardless of who prepares the removable portions or where the removable portions are printed, the tip-on process can cause alignment problems and increase make-ready time. Placing the preprinted removable portions in precise alignment on the advertising packets is difficult. The alignment problem is exacerbated if there is a need to turn the web to an upward angle in order to introduce a fold in the packet, after the removable portion has been married to the web.

Additionally, current practice calls for printing personalized information on the removable card or on the packet using an inkjet printer. The personalized information is therefore somewhat limited, such as the name and address of the recipient or the name and location of the nearest retail store for the advertiser. (The personalized information can be personalized to either the advertiser or the recipient or both.) It would be useful to be able to supply more detailed personalized information. It would also be useful to be able to track use of the removable portions by the recipients. For example, an advertiser can track a conventional discount coupon only by the number of coupons redeemed and the location of redemption. It would be useful if more demographic data were trackable, including by way of examples and not by way of limitation, the actual identity of recipients who redeemed the card or the postal codes of recipients who redeemed the cards. The conventional format does not permit these options.

Accordingly, there is a need for a less expensive, easily set up, single-pass system that minimizes the alignment problems and make-ready time for adding a removable portion to a packet of printed materials, and which allows for more detailed personalized information to be included on the removable portion and allows for this personalized information to be tracked. The present invention meets these needs.

SUMMARY OF THE INVENTION

Briefly, and in accordance with the foregoing, the present invention discloses a system with at least a first ribbon and a second ribbon, whereby the first ribbon will become removable portions and the second ribbon will become packets of printed materials; applying an adhesive to one side of the first ribbon; folding and gluing the first ribbon upon itself at least once to form a multi-ply ribbon; applying a plurality of labels, each of the labels comprising a magnetic strip, to the multi-ply ribbon; encoding personalized information onto each magnetic strip; cutting the multi-ply ribbon to form inner portions and outer portions; applying spot glue; marrying the multi-ply ribbon to the second ribbon; pulling off the outer portion, leaving the removable portion married to the second ribbon; and cutting the second ribbon into distributable packets, each containing a removable portion having a magnetic strip on which information has been encoded.

In another embodiment, the present invention discloses a system with at least a first ribbon, a second ribbon, and a third ribbon, whereby the first ribbon and the second ribbon will become removable portions and the third ribbon will become packets of printed materials; applying an adhesive to at least one of the first ribbon and the second ribbon; gluing the first ribbon to the second ribbon to form a multi-ply ribbon; applying a plurality of labels, each of the labels comprising a magnetic strip, to the multi-ply ribbon; encoding personalized information onto each magnetic strip; cutting the multi-ply ribbon to form inner and outer portions; applying spot glue; marrying the multi-ply ribbon to the third ribbon; and pulling off the outer portion, leaving the removable portion married to the third ribbon.

In yet another embodiment, at least one of the ribbons is coated with a protective coating or laminate to simulate the appearance of plastic.

In yet another embodiment, other personalized information is printed on the web, on one of the ribbons, on the removable portions, or on the packets.

In yet another embodiment, finishing operations are performed on at least one of the ribbons or the packets.

In one embodiment, a web printed on a web press is slit into at least the first ribbon and the second ribbon. In another embodiment, a plurality of webs is printed on a web press, and one web becomes the first ribbon and another web becomes the second ribbon.

In one embodiment, the multi-ply ribbon is die cut into an inner portion and an outer portion before it is married to another ribbon. The outer portion is removed to leave the removable formats. In another embodiment, the multi-ply ribbon is kiss cut after it is married to another ribbon. The outer portion is removed to leave the removable formats.

Mass-distributable packets of inserts with outer wraps can already be made in one continuous manufacturing process, using no premanufactured portions. The present invention can be used to incorporate a removable portion having personalized information, encoded and trackable, into such a mass-distributable advertising packet in a single-pass system, with greatly reduced alignment problems.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENTS

Figure 1A:
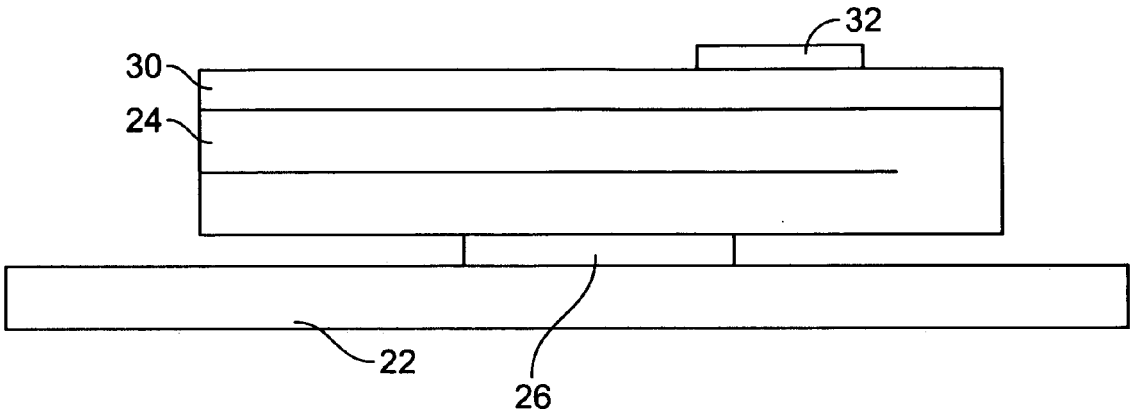
FIG. 1A is an elevational view of a packet of the preferred embodiment of the present invention, containing a removable portion having a label containing a magnetic strip on which personalized information has been encoded.

While the invention may be susceptible to embodiments in different forms, there is shown in the drawings, and herein will be described in detail, specific embodiments with the understanding that the present disclosure is to be considered an exemplification of the principles of the invention, and is not intended to limit the invention to that as illustrated and described herein.

Figure 1B:
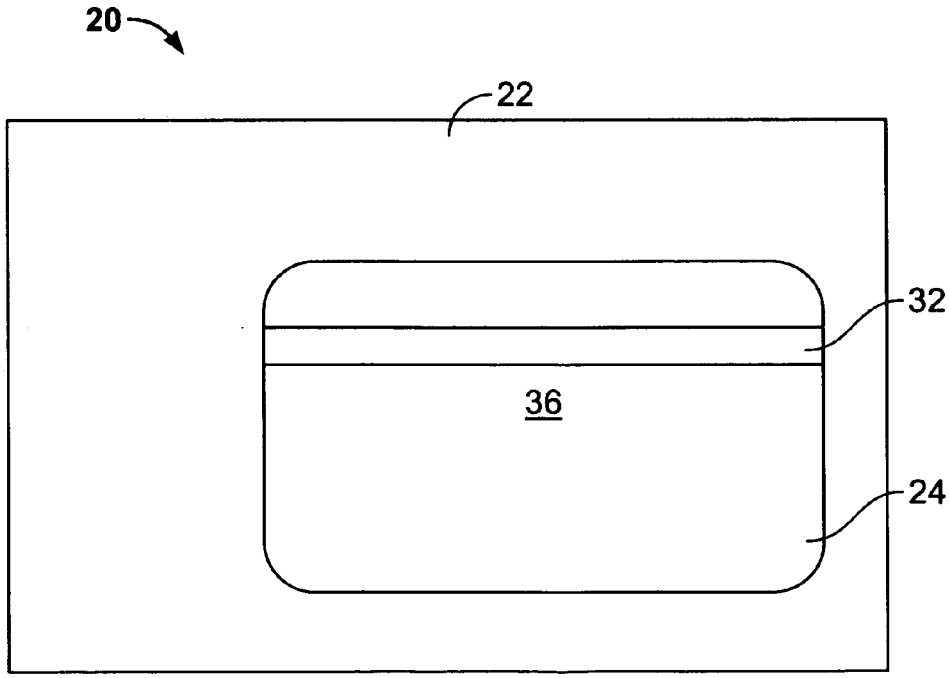
FIG. 1B is a plan view of a distributable packet of the preferred embodiment of the present invention, containing a removable portion having a label containing a magnetic strip on which personalized information has been encoded.

FIGS. 1A and 1B show a sample packet 20 with a main portion 22 and a removable portion 24, as manufactured by the method of the preferred embodiment of the present invention (not to scale). The removable portion 24 adheres to the main portion 22 by means of spot glue 26. Removable portion 24 is manufactured of the same stock as the main portion 22 but, in the illustrated embodiment, appears to be of stock at least twice as heavy as the stock of main portion 22. The original stock has been folded and glued upon itself, as will hereinafter be explained, to form a multi-ply portion 24, wherein the two layers of the original stock form the two plies of the multi-ply ribbon.

Label 30 contains a magnetic strip 32 on which encoded personalized information 34 has been introduced on one or more tracks. Additionally, printed personalized information 36 can appear either on removable portion 24 or on main portion 22 of packet 20. Removable portion 24 preferably meets the size requirements of ISO Standard 7810.

Label 30 is preferably a transparent material, preferably polyvinyl. Strip 32, incorporated into label 30, is a ferromagnetic material, preferably meeting ISO Standard CR80. Accordingly, strip 32 is preferably 0.375 in wide, spans the length of removable portion 24, and is located 0.223 in from the top of removable portion 24. The ferromagnetic material of strip 32 may be mixed directly into the polyvinyl of label 30 or may be contained in a separate strip of a plastic material that is then applied to the polyvinyl of label 30, as illustrated in FIG. 1A. The ferromagnetic material of strip 32 may be of high-coercivity or low-coercivity, depending on the end use. A material of high-coercivity is preferable for cards that are frequently used or which need to have a long life. A material of low-coercivity is preferable for a card that will be used only once or perhaps several times. Strip 32 contains encoded personalized information 34, as will hereinafter be described.

The encoded personalized information 34 on strip 32 can include such data as the recipient's name and address, other information particular to the recipient, or a dollar amount available for use by the recipient at the advertiser's retail establishment. By way of example only, and not by way of limitation, a health club could mail free 30-day passes to a large number of recipients, with each individual recipient's name and address encoded on each individual strip 32 of the removable portions 24. (Each recipient's name and address could be printed on removable portion 24 as well.) Those recipients who wish actually to use the free pass will take removable portion 24 off the packet 20 that explains detail about the health club (and which might have printed personalized information 36 as well, such as the location of the nearest facility). Upon entering the health club, the user swipes the removable portion 24 in the health club's magnetic card reader, which reads the recipient's encoded personalized information 34 and stores that data in a database. Accordingly, the health club can tell which recipients used the free pass and can analyze the data by age, ZIP Code, or any other demographic information that has been encoded on strip 32. (Since the health club anticipates that a recipient may use the removable portion 24 numerous times in the 30-day period, strip 32 in this example should be prepared of a material with high coercivity.)

By way of another example, again not by way of limitation, a retailer may mail discount offers to a large number of recipients, with a particular dollar amount encoded on strip 32 along with each recipient's name and address. By the same process described above, the retailer can tell which recipients took advantage of the discount and can analyze that information to tell, for example, what purchases the recipients made. (If the retailer in this example anticipates that the recipient will only use removable portion 24 one time, strip 32 may be prepared of a material of low coercivity. The removable portion 24, however, can be used numerous times if the retailer desires and a higher-coercivity ferromagnetic material is used.)

Please note that FIGS. 1A and 1B illustrate a simple embodiment of a sample packet 20. The web 210 as hereinafter described can be folded in a myriad of ways before or after the removable portion 24 is added to the main portion 22 to produce a packet 20, in ways well known in the art. Additionally, FIG. 1A illustrates a simple two-layer or two-ply removable portion, but a removable portion with three or more layers can also be made using the present invention. Thus, in the illustrated example, if main portion 22 is a brochure printed on seven-point paper (0.007 inch thick), the removable portion 24 will appear to the recipient to have been printed on 14-point paper (0.014 inch thick), even though both the main portion 22 of the brochure and the removable portion 24 were printed on the same seven-point paper. Additionally, since removable portion also has label 30 applied to it, removable portion 24 will appear to be of slightly heavier stock than twice the weight of the stock of main portion 22.

The method of manufacturing packet 20 will now be described. The method will be described as implemented by printing a single web of paper on a single web press. The invention can also be used to print two or more webs of paper on a single web press, or to print two or more webs of paper on multiple web presses.

Figure 2:
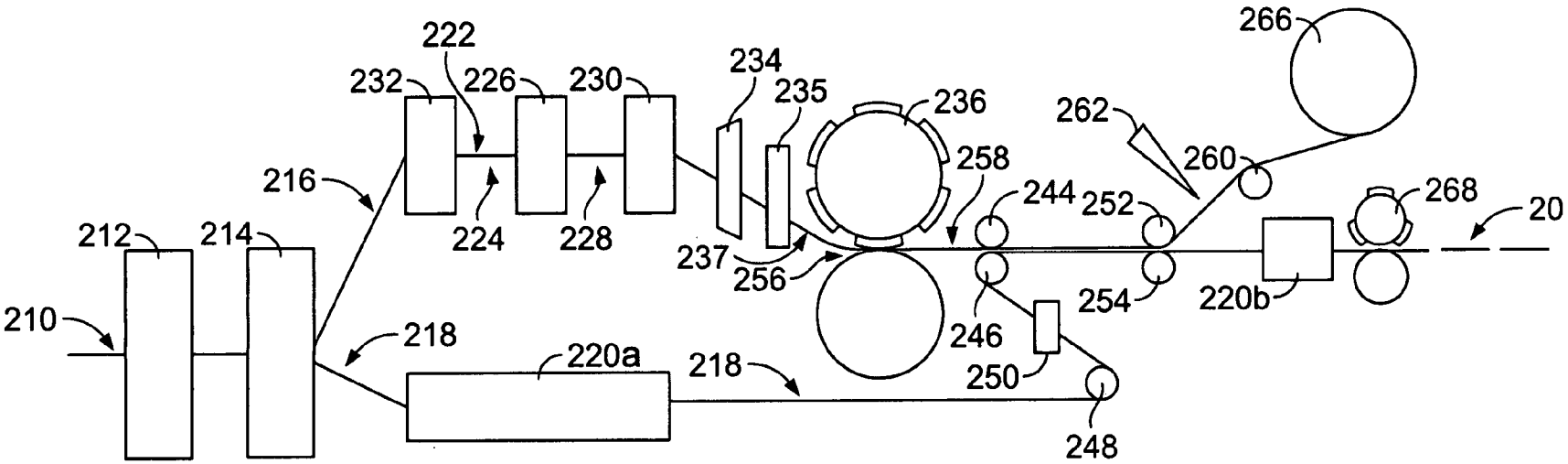
FIG. 2 is an elevational view of the finishing system that incorporates the features of the preferred embodiment of the invention.

The printed information 36 to be provided on the packet 20 is printed on a web of paper 210 in a standard web press 212, as shown in FIG. 2. A slitter 214 cuts the printed web 210 into a first or upper ribbon 216 comprising what will become the removable portions 24 in the example method shown and a second or lower ribbon 218 comprising what will become the main portion 22 of the packet 20 in the example method shown. Please note that the web 210 can first be slit into numerous pairs of ribbons, each pair of which becomes upper ribbon 216 and lower ribbon 218 as described herein. Moreover, the following description is of a simple two-ribbon embodiment, but the principles of the invention are adaptable to multiple-ribbon applications.

Please note that the lower ribbon 218 can be slit, folded, glued, and cut in a variety of ways in processing stations 220A before it is cut into packets 20, to create any number of variations of packet 20, depending on the number and type of packet 20 desired.

In the exemplary method shown, the upper ribbon 216 has a printed side 222 and a non-printed side 224. The upper ribbon 216 is rolled over an applicator 226 that applies adhesive 228 to the non-printed side 224 of the upper ribbon 216. The upper ribbon 216 is then folded upon itself by a plow 230 to glue the two folded halves of upper ribbon 216 to each other to form a multi-ply ribbon. Each half of upper ribbon 216 becomes one ply of the multi-ply ribbon. In the illustrated embodiment, the upper ribbon 216 is folded upon itself once, so that the upper ribbon 216 now has twice the thickness of the original paper (as illustrated in FIG. 1A). Additionally, the upper ribbon 216, having been folded in half, with printed side 222 to the outside, now has printed information on both sides. Thus, in the illustrated embodiment, the upper ribbon 216, which will be cut into removable portion 24, appears to be twice the thickness of the lower ribbon 218 and has information on both sides. More plows can be added in any combination to fold the upper ribbon 216 to create triple ply, quadruple ply, or higher order thicknesses. Because the upper ribbon 216 is folded and glued to create multiple layers, the finished removable portions 24, as will hereinafter be described, appear to be of heavier stock than the rest of the packets 20 to which the removable portions 24 are attached, even though the removable portion 24 and packet 20 were both originally printed from the same web 210.

In another embodiment, other finishing operations are applied to upper ribbon 216. Finishing operations include but are not limited to cutting, folding, aqueous coating, overall and spot UV coatings, film lamination, embossing, foil and hologram stamping, and post embossing.

For example, a protective coating or laminate, such as a UV underlayment, may be applied to the upper ribbon 216 at coating station 232. A UV underlayment will provide a slick appearance to the removable portion 24 and simulate plastic. Thus, for example, a temporary membership card sent in an advertising packet for a health club will have the appearance of a permanent plastic membership card. Please note that coating station 232, shown in the preferred embodiment located after slitter 214, can alternatively be placed before slitter 214, after plow 230, or elsewhere. Other coatings or laminates can be used as is known in the art, and other finishing operations can be used as is known in the art.

Furthermore, the web 210 or either of the ribbons 216, 218 can be printed with personalized information 36, by printing the personalized information 36 with the web press 212 or by using a separate, but in-line, inkjet printer 234. (Alternatively, personalized information 36 can be printed or otherwise placed on the packets 2.) Preferably, the upper ribbon 216 is printed with personalized information 36 after it has been folded into a multi-ply ribbon, but printer 234 can be placed to apply this information 36 at a different point in the system. Thus, in the example given above, the recipient may receive a packet 20 advertising a health club, with a removable portion 24 being a temporary membership card already containing the recipient's name and/or membership number printed on the removable portion 34 card (as well as encoded in strip 32). Or, a national health club may send packets 20 with the location and contact information of the local franchise printed either on the removable portion 24 or on the main portion 22.

In the preferred embodiment, labels 30 are then applied to upper ribbon 216 in ways known in the art, by label applicator 235. Label manufacturers supply labels 30, as is well known in the art, on carrier sheets, usually in a roll. Label applicators are well known in the art. Alternatively, labels 30 could be applied to upper ribbon 216 before it is folded into a multi-ply ribbon.

Write head 237 then writes encoded personalized information 34 onto each magnetic strip 32, preferably encoded by Aiken Biphase, or two-frequency coherent-phase encoding, preferably using either ANSI/ISO BCD Data Format or ANSI/ISO ALPHA Data Format. Other encoding methods as are well known in the art are acceptable, depending on the end use of removable portion 24. In the preferred embodiment, write head 237 writes encoded personalized information 34 onto each magnetic strip 32 before the die cutting step, as hereinafter described. Alternatively, strips 32 could have been encoded prior to application to upper ribbon 216, or write head 237 could be located downstream of the die cutting step.

Figure 3A:
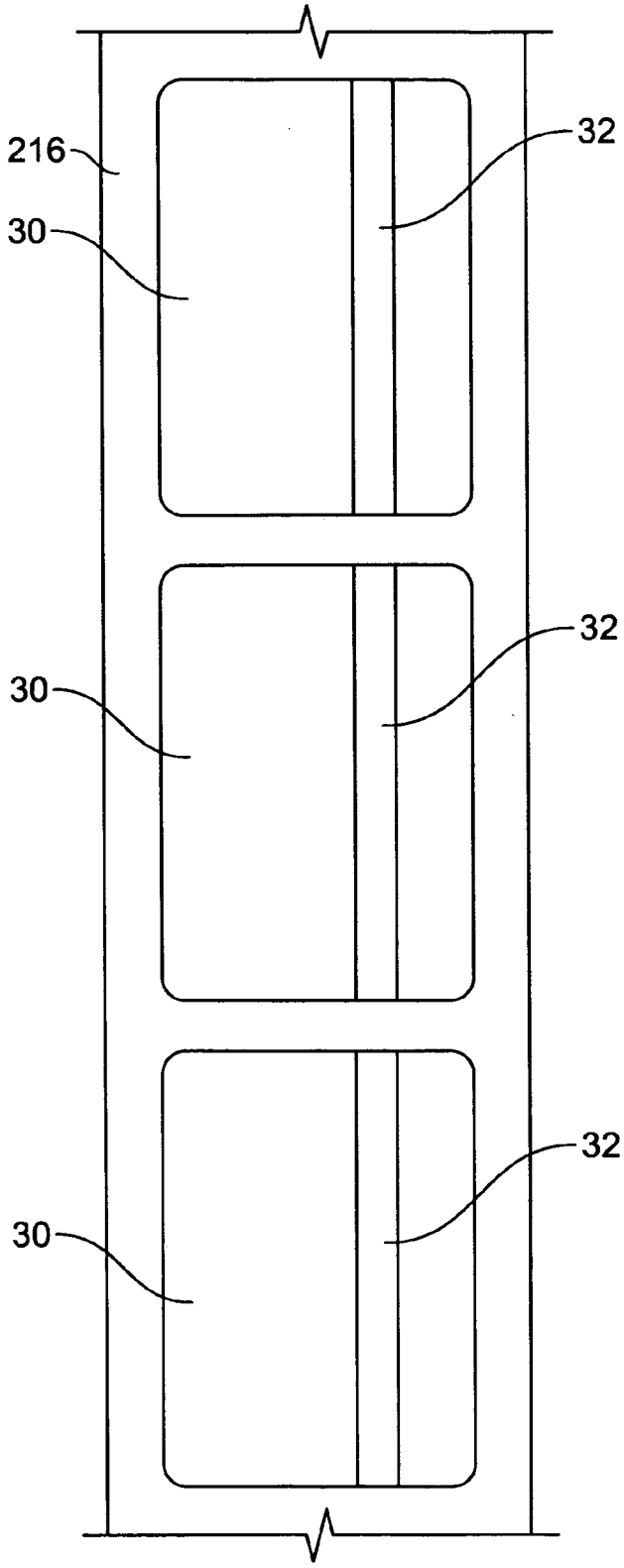
FIG. 3A is a plan view of the multi-ply ribbon of the preferred embodiment of the present invention, after application of labels but before cutting.
Figure 3B:
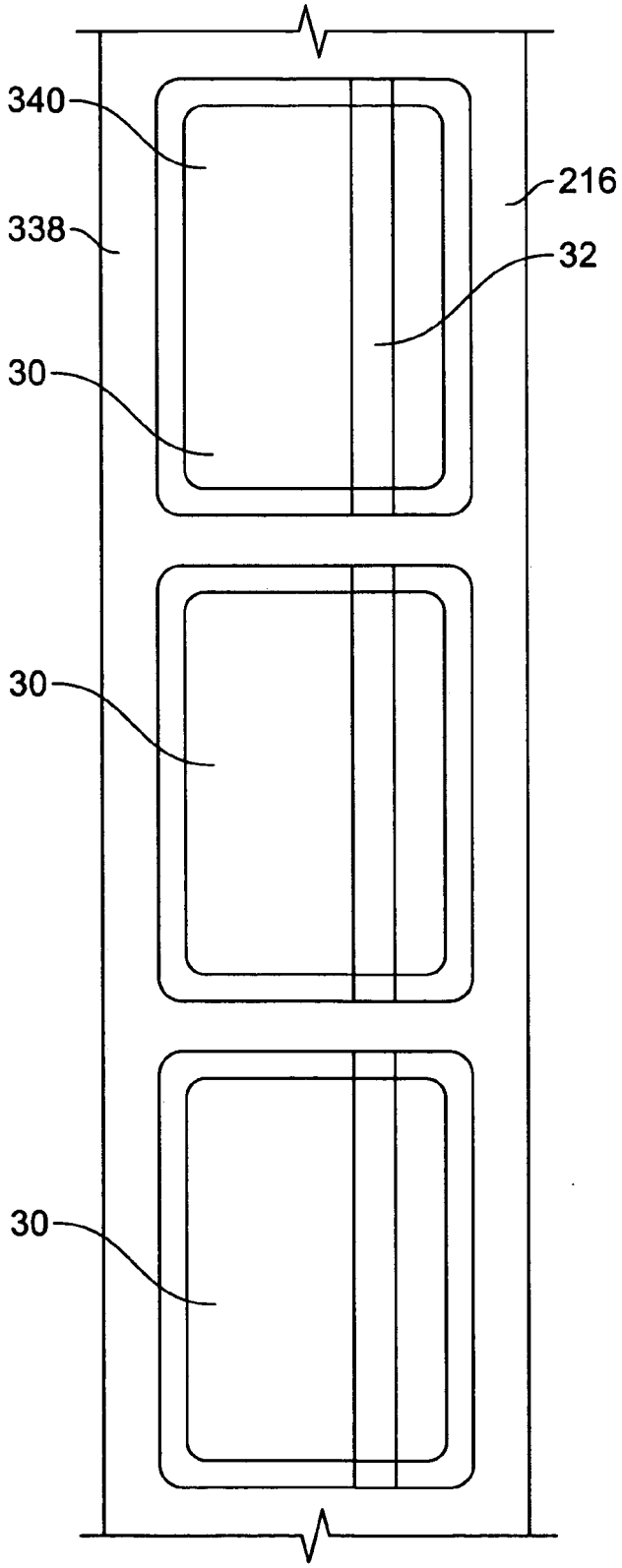
FIG. 3B is a plan view of the multi-ply ribbon of the preferred embodiment of the present invention, after cutting but before removal of the outer portion.

In the preferred embodiment, the upper ribbon 216 next enters a first rotary die cutter 236, which cuts the removable portions 24 in the upper ribbon 216. FIG. 3A shows a portion of the upper ribbon 216 of the preferred embodiment, after application of labels 30 but before die cutting. FIG. 3B shows a portion of upper ribbon 216 of the preferred embodiment, having been die cut into an outside portion or matrix 338 and an inside portion 340, separated by die cuts 342. As can be seen, labels 30 as applied to upper ribbon 216 are slightly larger than removable portion 24, so that each label 30, as applied, overlaps removable portion 24 by about one-quarter inch in all dimensions. Accordingly, once die cut, as will hereinafter be explained, each removable portion 24 will be completely covered by label 30, as illustrated in FIG. 1A, and a small amount of label 30, about one-quarter inch, will remain on matrix 338.

In the illustrated embodiment, the first rotary die cutter 236 cuts the removable portions 24 in a generally rectangular shape, such as for use as a credit card, pursuant to ISO Standard 7810. First rotary die cutter 236 can cut removable portions 24 in any shape desired by the used, however, as is well known in the art of rotary die cutters. The upper ribbon 216, upon exiting first rotary die cutter 236, enters a set of marrying rollers 244 and 246.

The lower ribbon 218 proceeds to processing stations 220A, which perform various finishing operations. The lower ribbon 218 can be folded and glued as needed for the final packet 20, or other finishing operations can be used. The lower ribbon 218 can be cut and folded, for example, into a return envelope for the recipient to send back to order goods or services or otherwise reply to the information in the packet. Other finishing operations include but are not limited to aqueous coating, overall and spot UV coatings, film lamination, embossing, foil and hologram stamping, and post embossing.

The lower ribbon 218 is next brought over a reversing roller 248 and into the set of marrying rollers 244, 246. Before entering the marrying rollers 244, 246, a spot gluer 250 puts dabs of spot glue 26 on the lower ribbon 218, at those locations where the removable portions 24 will be. (Alternatively, the spot gluer could place the dabs of spot glue 26 on the upper ribbon 216.) The marrying rollers 244, 246 then marry the upper ribbon 216 to the lower ribbon 218. The upper ribbon 216 adheres to the lower ribbon 218 by means of the spot glue 26. The two ribbons 216, 218 then proceed together to a set of nip rollers 252, 254.

In the preferred embodiment, the position of marrying rollers 244 and 246 are situated so that the distance 258 from the knife point 256 of die cutter 236 to the rollers 244, 246 is less than the longitudinal length of the inside portion 340. As the upper ribbon 216 exits the rotary cutter 230, the upper ribbon 216 proceeds into rollers 244, 246, so that inside portion 340 is never loose. In the preferred embodiment, the leading edge of each inside portion 340 contacts and rests upon the lower ribbon 218 at marrying rollers 244, 246 before the trailing edge of the inside portion 340 exits the knife point 256 of the rotary cutter 236.

Figure 3C:
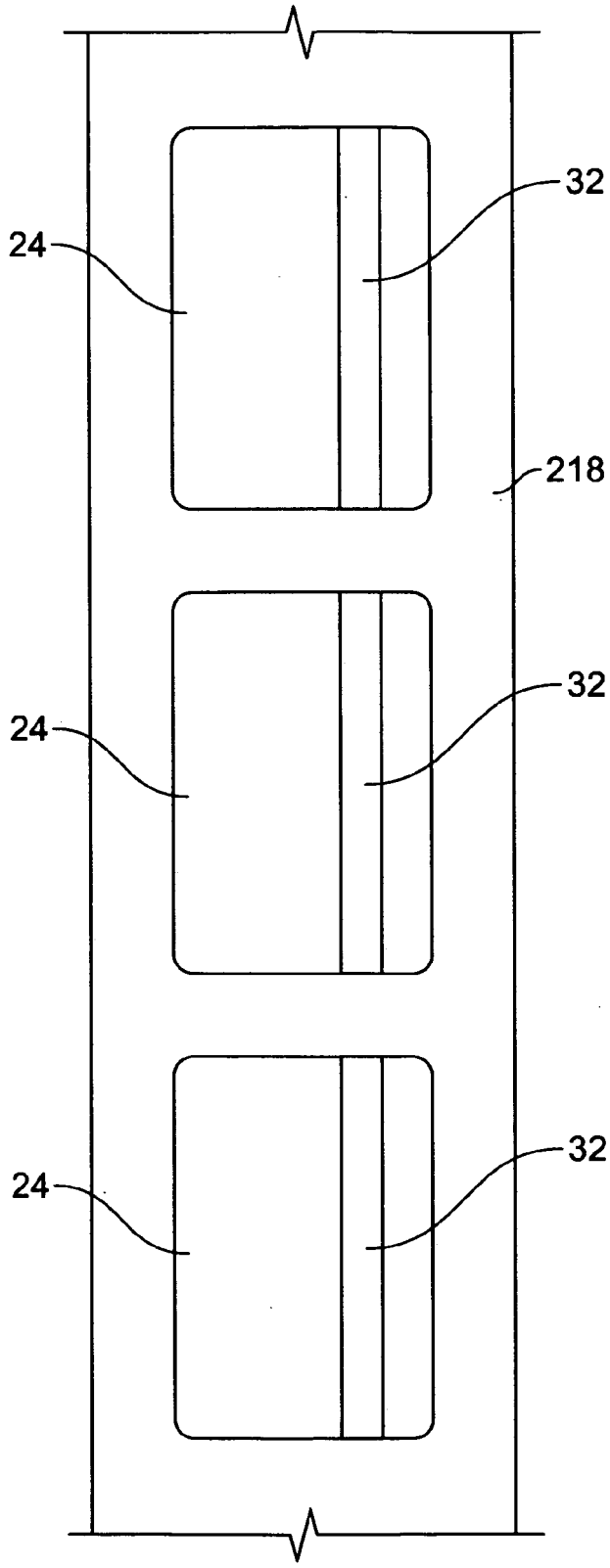
FIG. 3C is a plan view of the lower ribbon of the preferred embodiment of the present invention, after removal of the outer portion.

After the now married upper ribbon 216 and lower ribbon 218 pass through the nip rollers 252, 254, a pulling roller 260 pulls the matrix 338 off the lower ribbon 218. An air jet 262 selectively shoots compressed air 264 at upper ribbon 216 but only at inside portion 240. The matrix 338 then is pulled off lower ribbon 218. Because of the spot glue 26 and the pressurized air 264 from air jet 262, the pulling action of pulling roller 260 separates the matrix 338 from inside portion 340. Inside portion 340, which at this point has become removable portion 24, stays married to the lower ribbon 218, rather than following the matrix 338, and the matrix or outer portion 338 is fed to a disposal system 266, preferably a vacuum disposal system. FIG. 3C shows a portion of lower ribbon 218, having had upper ribbon 216 married to it and matrix 238 removed, leaving removable portions 24 attached to lower ribbon 218.

The lower ribbon 218, now carrying the removable portions 24, proceeds to finishing stations 220B for further finishing by methods known in the art, including but not limited to further folding, cutting, aqueous coating, overall and spot UV coatings, film lamination, embossing, foil and hologram stamping, and post embossing, if desired. As illustrated, finishing stations 220B are located after upper ribbon 216 has been married to lower ribbon 218. In other embodiments, finishing stations 220B can be located elsewhere and finishing operations as described above can be performed elsewhere. For example, finishing operations can be performed on the web 210 before it is printed or after it is printed but before it is slit. Finishing operations can be performed on the upper ribbon 216 at any point after the creation of upper ribbon 216 at slitter 214. Finishing operations can be performed on the packets 20 after finishing rotary cutter 268 cuts them, as will be described.

In the preferred embodiment, lower ribbon 218, after proceeding through one or more finishing operations as desired in finishing stations 220B, then proceeds to finishing rotary cutter 268, which transversely cuts lower ribbon 218 into packets 20.

Because the removable portions 24 are created from a ribbon running parallel to the ribbon from which the packets 20 are created, the alignment problems inherent in the "tip-on" process are greatly reduced.

In an alternative embodiment, upper ribbon 218 is printed on a first web 270 on web press 212 and lower ribbon 216 is simultaneously printed on second web 272 on the same web press 212. The two ribbons 216, 218 are thereafter processed as described above.

In another alternative embodiment, upper ribbon 216 is printed on a first web press 274 and processed as described above. In this embodiment, however, lower ribbon 218 is simultaneously printed on a second web press 276 and processed as described above. The two ribbons 216, 218 are thereafter married and processed as described above.

In yet another embodiment, a kiss cut is used to create the removable portions 6. (Kiss cutting is cutting through a first ribbon and not cutting through a second ribbon that has been married to the first ribbon.) In this embodiment, after the upper ribbon 216 has been folded and glued into a multi-ply ribbon, as described above, and labels 30 have been applied, upper ribbon 216 is married to lower ribbon 218 by marrying rollers 244, 246. First die cutter 236 performs a kiss-cut to create the removable portions 24 in the upper ribbon 216, by cutting the upper ribbon 214 into an outside portion or matrix 338 and an inside portion 340, separated by cuts 342. Because a kiss cut is made, the cuts 342 do not extend into the lower ribbon 218. Pulling roller 260 pulls the matrix 338 off upper ribbon 216 as described above and the lower ribbon 218, now carrying the removable portions 24, proceeds for further finishing as described above.

In yet another embodiment, separate ribbons are glued together to create a multi-ply ribbon. In this embodiment, slitter 214 creates two upper ribbons 216 and 216'. Glue is applied to at least one of the upper ribbons 216 and 216' by applicator 226 and upper ribbons 216 and 216' are glued together to create a multi-ply ribbon (in this case, a two-ply ribbon). That multi-ply ribbon is married to lower ribbon 218 as described above.

In yet another embodiment, a combination of folding and separate ribbons is used. To create, for example, a three-ply removable portion, slitter 214 creates two upper ribbons 216 and 216', where upper ribbon 216 is approximately twice the width of upper ribbon 216'. Upper ribbon 216 is then glued at applicator 226 and folded at plow 230. Upper ribbon 216' is sandwiched into upper ribbon 216 during the folding and gluing operation, to create a three-ply ribbon. The two folded halves of upper ribbon 216 form the two outer plies and upper ribbon 216' forms the middle ply, with all three plies glued together to form a multi-ply ribbon. That three-ply ribbon proceeds to be married to lower ribbon 218 as described above. Thus, a packet 20 may have a main portion 22 that is a brochure printed on seven-point paper with a removable portion 24 that appears to be 21-point paper (plus the label 30), even though the removable portion 24 was printed on the same seven-point paper as the main portion 22.

Figure 4:
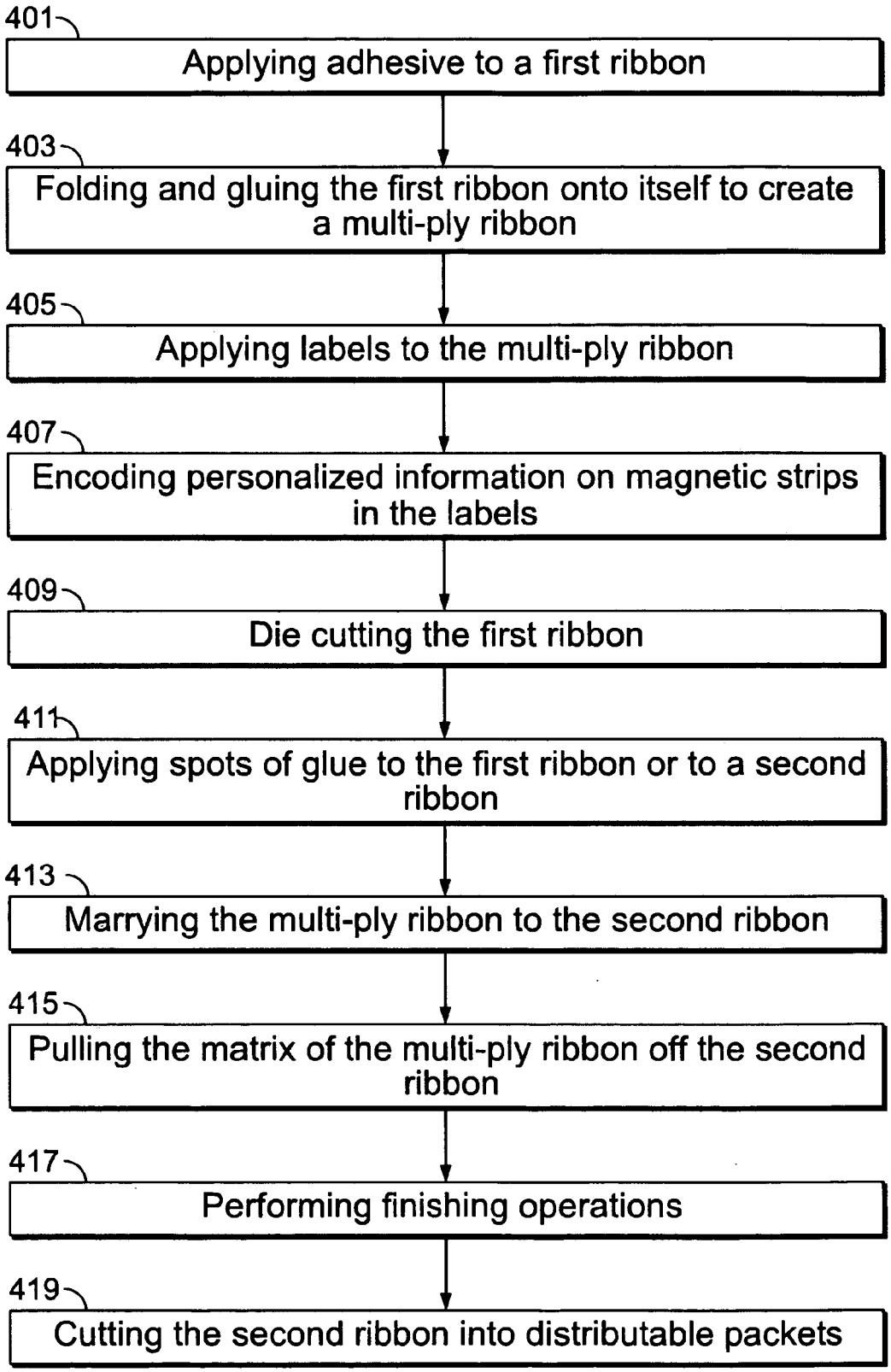
FIG. 4 is a block diagram of the method of the preferred embodiment of the invention.

The method of the preferred embodiment of the present invention is diagramed in FIG. 4 and consists of the following steps, which need not be performed in this order:

1. Applying adhesive to a first ribbon 401;
2. Folding and gluing the first ribbon onto itself to create a multi-ply ribbon 403;
3. Applying labels to the multi-ply ribbon 405;
4. Encoding personalized information on magnetic strips in the labels 407;
5. Die cutting the first ribbon 409;
6. Applying spots of glue to the first ribbon or to a second ribbon 411;
7. Marrying the multi-ply ribbon to the second ribbon 413;
8. Pulling the matrix of the multi-ply ribbon off the second ribbon 415;
9. Performing finishing operations 417; and
10. Cutting the second ribbon into distributable packets 419.

Please note that these steps may be performed in different order without departing from the present invention. Finishing operations (step 417) can be performed at various points in the process, on one of the ribbons or on the completed packets. The labels can be applied (step 405) to the first ribbon before it is folded into a multi-ply ribbon. The first ribbon can be folded upon itself partially, to form a partially-multi-ply ribbon, which can then be slit into a single-ply second ribbon and a multi-ply ribbon. The step of encoding personalized information (step 407) on the magnetic strips can occur at other points in the process.

Moreover, a step of printing personalized information on either the web, one of the ribbons, or the packets, may be inserted at various points of the process. A step of applying a coating or laminate can be performed at various points in the process.

The first and second ribbons are preferably obtained by slitting a web printed on a web press. Alternatively, two webs can be printed in a single web press or two webs can be printed on two web presses.

Figure 5:
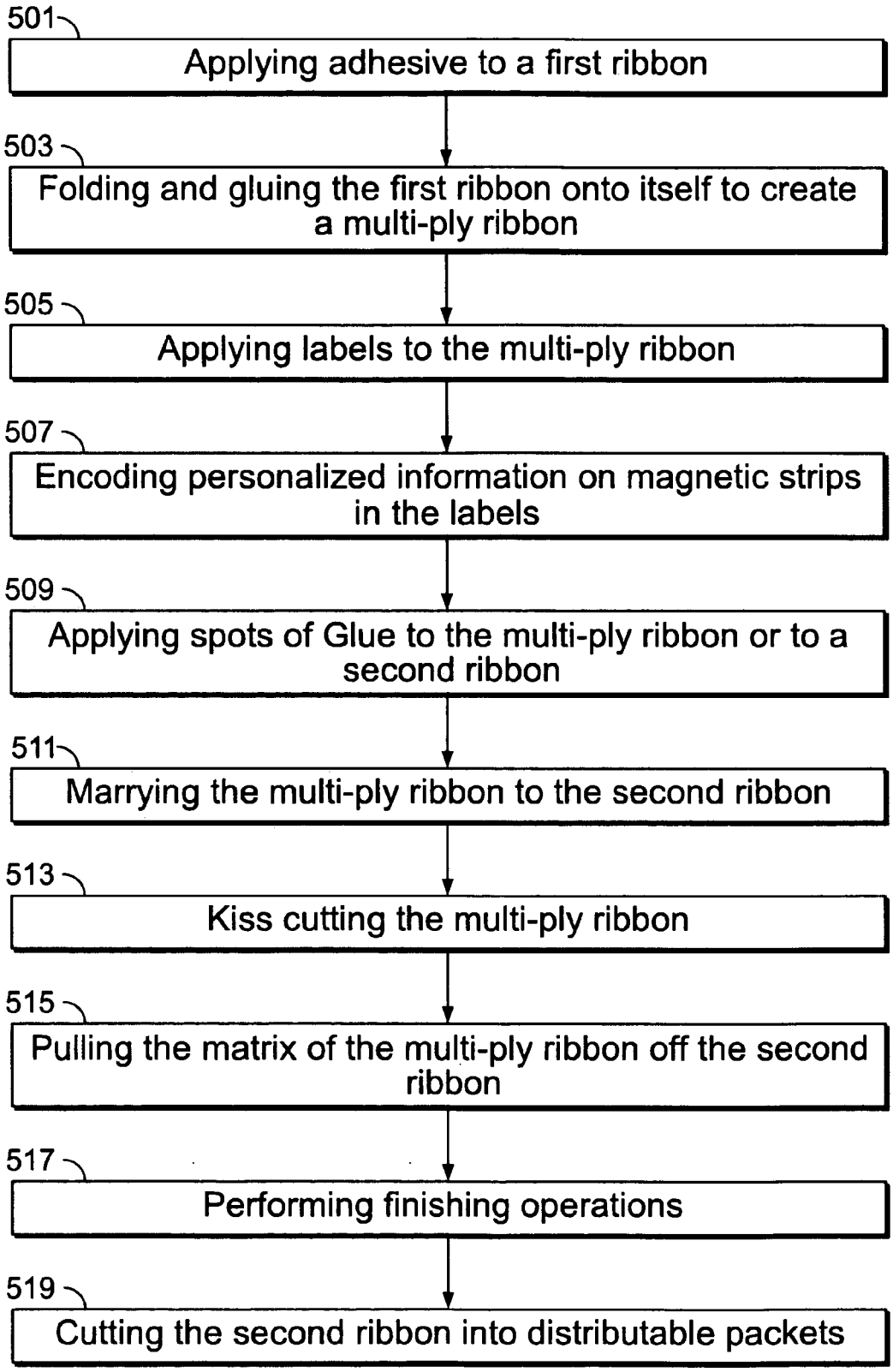
FIG. 5 is a block diagram of the method of another embodiment of the invention.

The method of another alternative embodiment of the present invention, in which a kiss cutter is used instead of a die cutter, is diagrammed in FIG. 5 and consists of the following steps:

1. Applying adhesive to a first ribbon 501;
2. Folding and gluing the first ribbon onto itself to create a multi-ply ribbon 503;
3. Applying labels to the multi-ply ribbon 505;
4. Encoding personalized information on magnetic strips in the labels 507;
5. Applying spots of glue to the multi-ply ribbon or to a second ribbon 509;
6. Marrying the multi-ply ribbon to the second ribbon 511;
7. Kiss cutting the multi-ply ribbon 513;
8. Pulling the matrix of the multi-ply ribbon off the second ribbon 515;
9. Performing finishing operations 517; and
10. Cutting the second ribbon into distributable packets 519.

Please note that these steps may be performed in different order without departing from the present invention. Finishing operations (step 517) can be performed at various points in the process, on one of the ribbons or on the completed packets. The labels can be applied (step 505) to the first ribbon before it is folded into a multi-ply ribbon. The first ribbon can be folded upon itself partially, to form a partially-multi-ply ribbon, which can then be slit into a single-ply second ribbon and a multi-ply ribbon. The step of encoding personalized information (step 507) on the magnetic strips can occur at other points in the process.

Moreover, a step of printing personalized information on either the web, one of the ribbons, or the packets, may be inserted at various points of the process. A step of applying a coating or laminate can be performed at various points in the process.

The first and second ribbons are preferably obtained by slitting a web printed on a web press. Alternatively, two webs can be printed in a single web press or two webs can be printed on two web presses.

Figure 6:
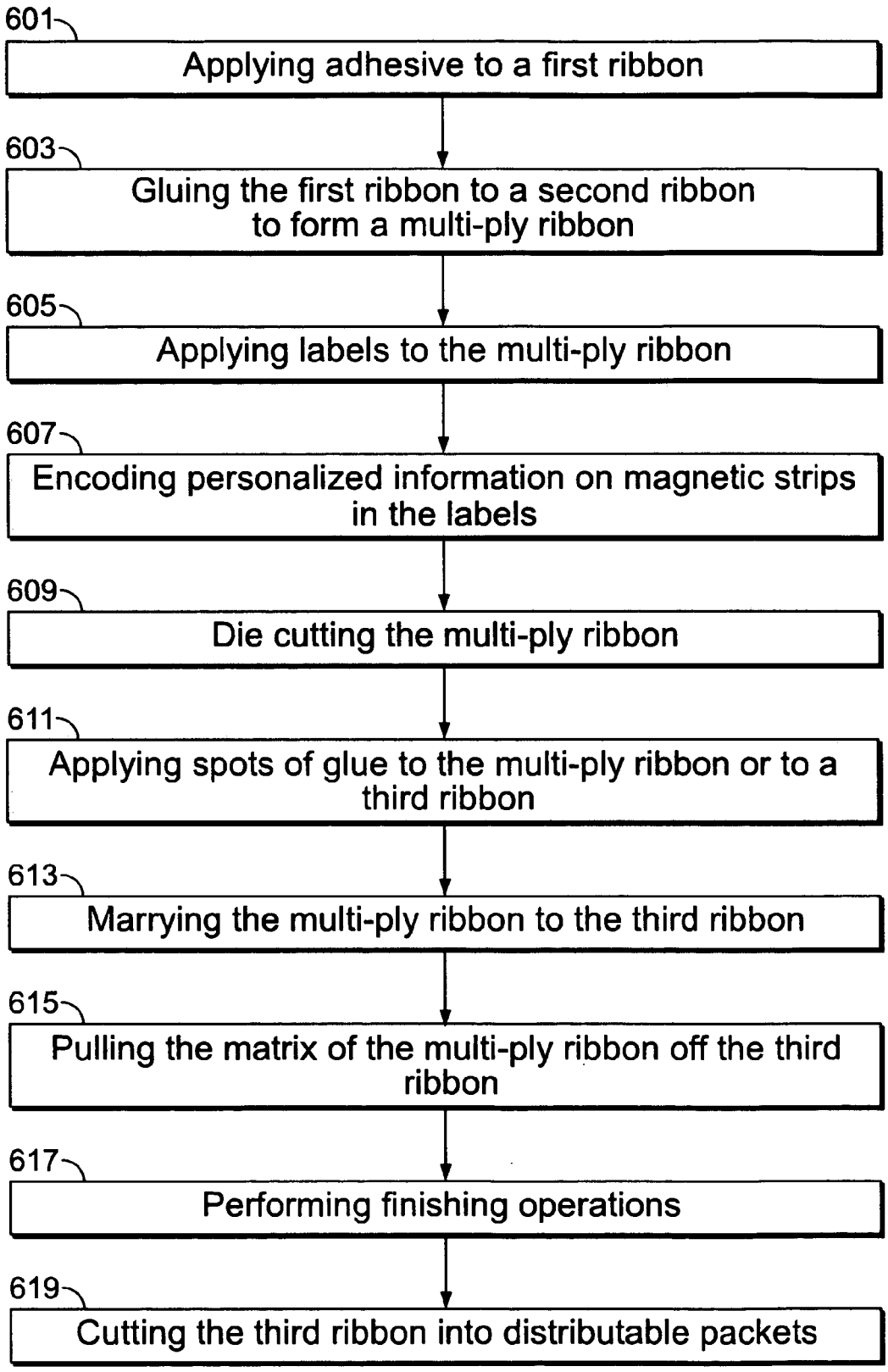
FIG. 6 is a block diagram of the method of yet another embodiment of the invention

The method of another embodiment of the present invention is diagramed in FIG. 6 and consists of the following steps, which need not be performed in this order:

1. Applying adhesive to a first ribbon 601;
2. Gluing the first ribbon to a second ribbon to form a multi-ply ribbon 603;
3. Applying labels to the multi-ply ribbon 605;
4. Encoding personalized information on magnetic strips in the labels 607;
5. Die cutting the multi-ply ribbon 609;
6. Applying spots of glue to the multi-ply ribbon or to a third ribbon 611;
7. Marrying the multi-ply ribbon to the third ribbon 613;
8. Pulling the matrix of the multi-ply ribbon off the third ribbon 615;
9. Performing finishing operations 617; and
10. Cutting the third ribbon into distributable packets 619.

Please note that these steps may be performed in different order without departing from the present invention. Finishing operations (step 617) can be performed at various points in the process, on one of the ribbons or on the completed packets. The labels can be applied (step 605) to the first ribbon or the second ribbon before they are married to form the multi-ply ribbon. The first ribbon can be less wide than the second ribbon so that marrying the two ribbons forms a partially-multi-ply ribbon, which can then be slit into a single-ply third ribbon and a multi-ply ribbon. The step of encoding personalized information (step 607) on the magnetic strips can occur at other points in the process.

Moreover, a step of printing personalized information on either the web, one of the ribbons, or the packets, may be inserted at various points of the process. A step of applying a coating or laminate can be performed at various points in the process.

The first, second, and third ribbons are preferably obtained by slitting a web printed on a web press. Alternatively, two or more webs can be printed in a single web press or two or more webs can be printed on two or more web presses.

Figure 7:
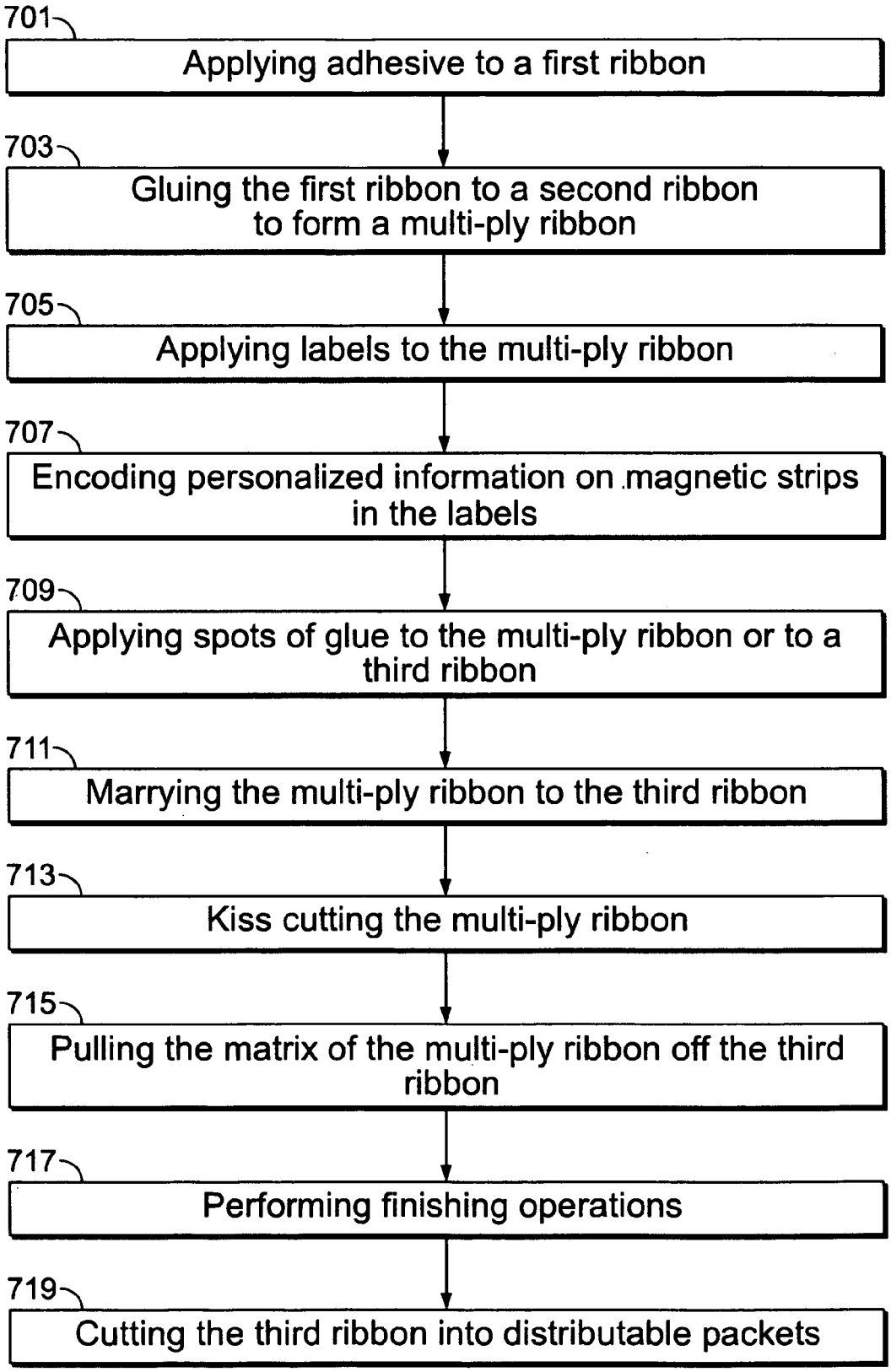
FIG. 7 is a block diagram of the method of yet another embodiment of the invention.

The method of yet another alternative embodiment of the present invention, in which a kiss cutter is used instead of a die cutter, is diagrammed in FIG. 7 and consists of the following steps:

1. Applying adhesive to a first ribbon 701;
2. Gluing the first ribbon to a second ribbon to form a multi-ply ribbon 703;
3. Applying labels to the multi-ply ribbon 705;
4. Encoding personalized information on magnetic strips in the labels 707;

5. Applying spots of glue to the multi-ply ribbon or to a third ribbon 709;
6. Marrying the multi-ply ribbon to the third ribbon 711;
7. Kiss cutting the multi-ply ribbon 713;
8. Pulling the matrix of the multi-ply ribbon off the third ribbon 715;
9. Performing finishing operations 717; and
10. Cutting the third ribbon into distributable packets 719.

Please note that these steps may be performed in different order without departing from the present invention. Finishing operations (step 717) can be performed at various points in the process, on one of the ribbons or on the completed packets. The labels can be applied (step 705) to the first ribbon or the second ribbon before they are married to form a multi-ply ribbon. The first ribbon can be less wide than the second ribbon so that marrying the two ribbons forms a partially-multi-ply ribbon, which can then be slit into a single-ply third ribbon and a multi-ply ribbon. The step of encoding personalized information (step 707) on the magnetic strips can occur at other points in the process.

Moreover, a step of printing personalized information on either the web, one of the ribbons, or the packets, may be inserted at various points of the process. A step of applying a coating or laminate can be performed at various points in the process.

The first and second ribbons are preferably obtained by slitting a web printed on a web press. Alternatively, two webs can be printed in a single web press or two webs can be printed on two web presses.

Please note also the step of pulling off the matrix (steps 415, 515, 615, and 175) is optional. For some removable portion applications, the advertiser may choose to leave the matrix attached to the second ribbon.

While preferred embodiments of the present invention are shown and described, it is envisioned that those skilled in the art may devise various modifications of the present invention.

What is claimed is:

1. A method of making a distributable packet including a removable portion having personalized information, in a continuous, single-path finishing system, comprising:

printing at least one web which provides a first ribbon and a second ribbon on a web press;

applying a non-releasable adhesive to said first ribbon;

folding and permanently gluing said first ribbon onto itself to form a multi-ply ribbon;

applying labels to said multi-ply ribbon, each of said labels comprising a magnetic strip;

encoding personalized information onto each said magnetic strip;

cutting said multi-ply ribbon into a plurality of removable portions;

marrying said multiply ribbon to said second ribbon; and cutting said second ribbon into packets.

2. The method of claim 1, further comprising applying at least one of a coating and a laminate to at least one of said first ribbon, said second ribbon, and said multi-ply ribbon.

3. The method of claim 1, further comprising printing personalized information on at least one of said first ribbon, said second ribbon, said multi-ply ribbon, and said packets.

4. The method of claim 1, wherein said cutting said multi-ply ribbon step comprises die cutting said multiply ribbon to create an outside portion.

5. The method of claim 4, further comprising removing said outside portion.

6. The method of claim 5, wherein said removing step comprises pulling said outside portion with a pulling roller.

7. The method of claim 1, wherein said cutting said multi-ply ribbon step comprises kiss-cutting said multi-ply ribbon to create an outside portion.

8. The method of claim 7, further comprising removing said outside portion.

9. The method of claim 8, wherein said removing step comprises pulling said outside portion with a pulling roller.

10. The method of claim 1, further comprising finishing at least one of said first ribbon, said second ribbon, and said multiply ribbon.

11. The method of claim 1, further comprising slitting said at least one web into said first ribbon and said second ribbon.

12. The method of claim 1, said printing at least one web further comprising printing a plurality of webs on said web press, wherein a first one of said plurality of webs comprises said first ribbon and a second one of said plurality of webs comprises said second ribbon.

13. The method of claim 1, said printing at least one web further comprising printing a first web on a first web press, said first web comprising said first ribbon, and printing a second web on a second web press, wherein said second web comprises said second ribbon.

* * * * *